US006674353B1

(12) United States Patent
Hanke et al.

(10) Patent No.: US 6,674,353 B1
(45) Date of Patent: Jan. 6, 2004

(54) MAGNET SYSTEM FOR A RELAY

(75) Inventors: Martin Hanke, Berlin (DE); Ralf Hoffmann, Berlin (DE); Josef Kern, Berlin (DE); Karsten Pietsch, Berlin (DE)

(73) Assignee: Tyco Electronics Logistics AG, Steinach (CH)

( * ) Notice: Subject to any disclaimer, the term of this patent is extended or adjusted under 35 U.S.C. 154(b) by 0 days.

(21) Appl. No.: 09/958,182

(22) PCT Filed: Apr. 3, 2000

(86) PCT No.: PCT/IB00/00399

§ 371 (c)(1),
(2), (4) Date: Jun. 17, 2002

(87) PCT Pub. No.: WO00/60624

PCT Pub. Date: Oct. 12, 2000

(30) Foreign Application Priority Data

Apr. 7, 1999 (DE) ..... 199 15 692

(51) Int. Cl.[7] ..... H01H 51/08

(52) U.S. Cl. ..... 335/276; 335/270; 335/279; 335/281

(58) Field of Search ..... 335/78–86, 270, 335/275, 276, 279, 281

(56) References Cited

U.S. PATENT DOCUMENTS

| | | | | |
|---|---|---|---|---|
| 3,436,702 A | 4/1969 | Zhezmer et al. | ..... | 335/276 |
| 5,455,550 A | 10/1995 | von Alten et al. | ..... | 335/78 |
| 5,852,392 A | 12/1998 | Aharonian | ..... | 335/80 |

FOREIGN PATENT DOCUMENTS

| | | | | |
|---|---|---|---|---|
| DE | 835 459 | 8/1951 | ..... | 20/29 |
| EP | 0 081 604 A1 | 6/1983 | ..... | H01H/50/16 |
| EP | 0 281 384 B1 | 9/1988 | ..... | H01H/50/30 |
| EP | 0310 091 A2 | 4/1989 | ..... | H01H/50/44 |
| EP | 0 425 780 A2 | 5/1991 | ..... | H01H/50/16 |
| JP | 63-266724 A | 2/1988 | ..... | H01H/51/06 |
| WO | 98/31037 | 7/1998 | ..... | H01H/51/22 |

OTHER PUBLICATIONS

Copy of German Search Report Enclosed.

*Primary Examiner*—Ramon M. Barrera

(57) ABSTRACT

The magnet system is part of a relay, which displays particularly low-noise switching. Components of the magnet system include a core unit (1), an armature (6) and a not represented coil, whereby the armature (6) is preloaded in an open position. The low-noise switching behavior is achieved in that the armature (6) is designed in such a manner that the armature pole face in the region of its front end (8*a*) in the closing direction is essentially perpendicular to a connecting line (16) towards the bearing edge (12). In addition, when the armature (6) is attracted, the core pole face (9) extends at least substantially parallel to the armature pole face (8). The arrangement according to the invention requires no additional parts for the purpose of noise reduction, resulting in a particularly simple and compact structure.

24 Claims, 3 Drawing Sheets

MAGNET SYSTEM FOR A RELAY

The invention relates to a magnet system for a relay with the following characteristic features:

a core unit with at least two legs, whereby at least one armature bearing section is created on a first leg and a pole section is created on a second leg, an armature, which is pivotally mounted on the armature bearing section around a bearing edge and preloaded by a spring force in an open position, whereby a working air gap is created between an armature pole face on a free armature end and a core pole face on the pole section, and a coil, which surrounds the core unit at any chosen position.

Magnet systems for electromagnetic relays for the switching of direct current loads, as preferably used in motor vehicles, cause disturbing switching noises in the inside of the vehicle. In order to reduce these switching noises, which arise in particular from the impact of an armature on a pole face, it is for instance known to use a double-walled housing with sound absorbing features. This known measure is elaborate and expensive; it increases the volume of the relay and merely offers a sound absorbing or sound deadening effect, whereas the actual problem of the sound formation is not solved. In addition, the noise can be transferred outside via a connecting conductor. Furthermore, through the use of a double-walled housing, the heat conductivity of the housing is reduced whereby the operational capability of this type of relay is limited.

A solution for the avoidance of the noise formation consists in using a magnet system comprising a damper for the reduction of the speed of movement of the armature.

A relay is known from EP 0 281 384 B1, in which a noise reduction is achieved by reducing the speed of the armature. In this relay an additional air damper is coupled to the armature and the contact spring system. The disadvantage of this construction is that the relay becomes more expensive due to the damper and that in addition the space required increases.

It is the object of the invention to provide a magnet system of the above type which is simple in structure but nevertheless displays a low-noise switching behavior.

According to the invention, this object is achieved by a magnet system of the above type which is characterised in that the armature pole face in the region of its front end in the closing direction is essentially perpendicular to a connecting line towards the bearing edge and in that the core pole face extends at least substantially parallel to the armature pole face when the armature is attracted.

The arrangement according to the invention is advantageous in that the movement of the armature, directly before the closing position is reached, approaches the pole faces in a flattening angle, so that the pole faces of the armature and the core unit in the resting position of the closed state are parallel to each other.

A particularly simple structure is also obtained in that no additional parts are required to achieve a low-noise switching behavior.

The armature movement is preferably limited by a stop, which is positioned close to the bearing edge. In an advantageous embodiment, this is achieved in a particularly simple manner, in that the armature bearing section also forms the stop.

A particularly good noise reduction is achieved when the working air gap between the pole faces is not completely closed during the closing of the armature, i.e. so that a residual working air gap remains, whereby the armature pole face and the core pole face are parallel to each other.

Further details and embodiments are described in the dependent claims.

The invention will be described in more detail by reference to an embodiment and to the corresponding drawings, in which.

Figure 1:
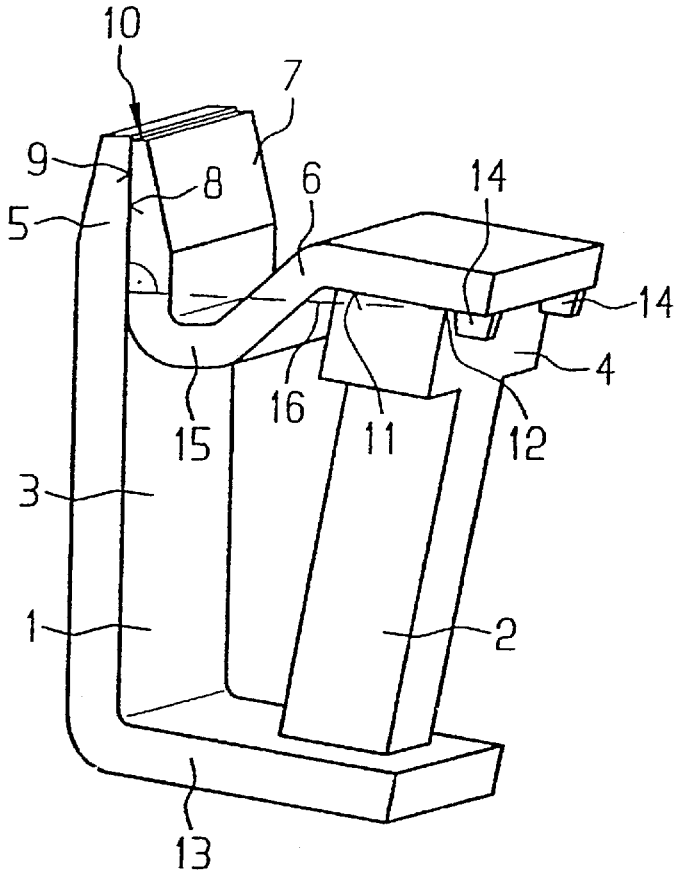
FIG. 1 shows a perspective view of a magnet system according to the invention.

In an embodiment according to FIG. 1, a core unit 1 comprises a first leg 2 and a second leg 3, which are connected by means of a cross piece 13. The second leg 3 is positioned on the cross piece 13 at an obtuse angle. This U-shaped arrangement results in an armature bearing section 4 on the first leg 2 and a pole section 5 on the second leg 3. An approximately L-shaped armature 6, which is pivotally mounted on the armature bearing section 4 around a bearing edge 12, closes the magnet, circle over the working air gap 10 between the armature bearing section 4 and the pole section 5. The armature 6 is arranged in such a manner, that the transverse leg of the L, which in FIG. 1 corresponds to a free armature end 7, points outwardly.

The armature 6 deviates from a straight L shape, in that in a middle section 15 it is bent inwardly, resulting in a bend with relation to the armature end on the armature bearing section 4. In conjunction with the inclined second leg 3, the structure size can thus be reduced.

The working air gap 10 is located between the pole section 5, which forms a core pole face 9, and the free armature end 7, which forms an armature pole face 8. On the armature bearing section 4, the armature 6, in the closed position, is adjacent to an armature bearing surface 11 of the armature bearing section 4. Two projections 14 are integrally formed on the armature 6, so that the armature 6 cannot slip in the direction of the pole section 5 and be completely attracted to the latter. This ensures that a residual working air gap 10 remains. In addition to avoiding an impact noise, a jamming or sticking of the armature 6 in the closed position is thus avoided.

In order to achieve a high level of efficiency of the magnet circle, the core unit 1 and the armature 6, 40, 50 and 60 are made from ferromagnetic material. The use of other materials, however, is also conceivable, whereby the efficiency of the magnet circle is in that case reduced, while the advantageous noise behavior is maintained.

Figure 2:
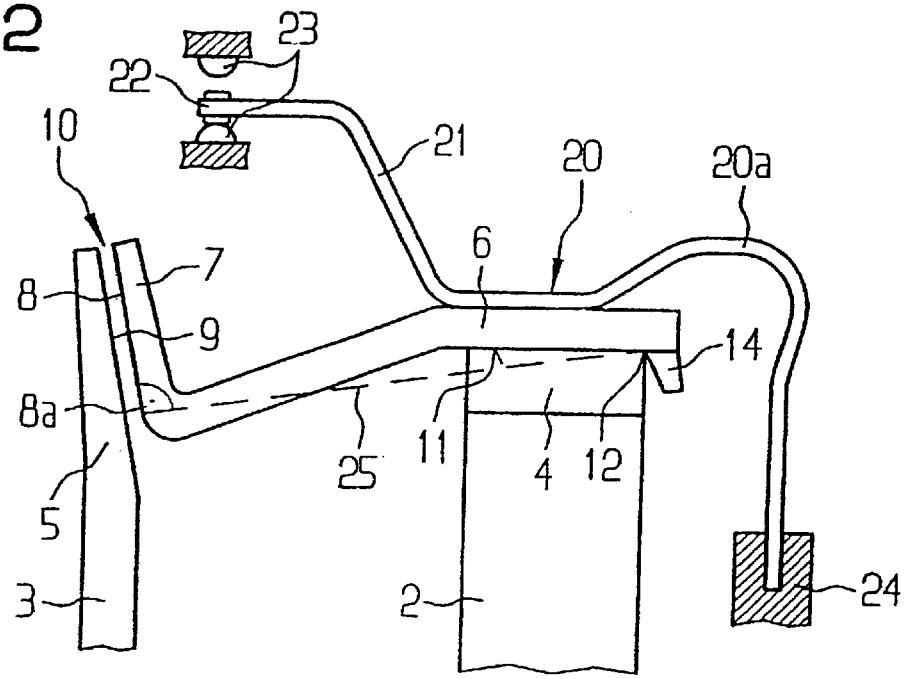
FIG. 2 shows the configuration of the core pole face and the armature of a magnet system according to the invention.

FIG. 2 shows a diagrammatic representation of the essential elements of the invention. The armature 6 is designed so that the armature pole face 8 in the region of its front end 8*a* in the closing direction is essentially perpendicular to a connecting line 25, shown as a broken line in FIG. 2, towards the bearing edge 12. When the armature 6 is attracted, as a result of the arrangement of the core pole face 9 and the armature 6, the core pole face 9 extends substantially parallel to the armature pole face 8, so that the core pole face 9 is also perpendicular to the connecting line 25.

FIG. 2 also shows a diagrammatic representation of the arrangement of a combined bearing, restoring and contact spring 20. A first section 20*a* of this spring 20 assumes a restoring function and in addition presses the armature 6 against the bearing edge 12. This prevents the armature 6 from lifting off in the region of the bearing edge 12. The end of this section 20*a* is securely attached in a restraint 24 with a fixed part of the arrangement, for instance a housing which is to be added. A second section forms the contact spring 21, which carries a movable contact 22, which in each case cooperates with one of the fixed contacts 23, depending on the position of the armature 6.

Figure 3:
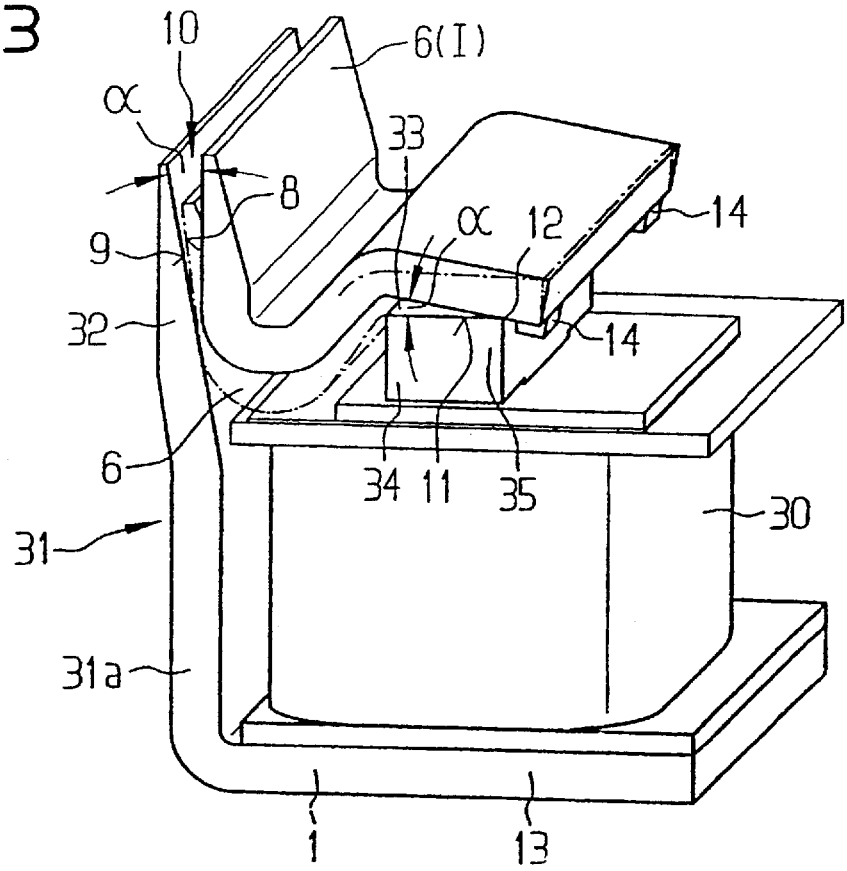
FIG. 3 shows a magnet system similarly to FIG. 1, complemented by a coil, whereby the armature is shown in two end positions.

FIG. 3 shows a slight variation of the magnet system of FIG. 1. In contrast to the second leg 3 of FIG. 1, a second leg 31 displays a kink, so that the leg section 31*a* positioned on the cross piece 13 is perpendicular to the latter, whereas the pole section 32, in an intended extension with the cross piece 13, displays a slightly obtuse angle. In addition, FIG. 3 shows a coil 30, which surrounds a first leg 34. The armature 6 is preloaded in an open position and indicated in this position with 6(I). In this position, the pole faces 8 and 9 are at an acute angle α to each other, so that the working air gap 10 is wedge-shaped.

Between the armature 6 and the armature bearing surface 11 on an armature bearing section 35, an aperture angle 33 is created, which corresponds to the angle α between the pole faces 8 and 9. The aperture angle 33 is relatively large at 6° to 15° in comparison to the corresponding angle of a conventional folding armature system, which is typically about 5°. In addition, the pole faces 8 and 9 do not completely overlap.

As soon as a magnetic flux is generated in the magnet system by emerging the coil 30, the armature 6 moves against the spring tension in a pivot process around the bearing edge 12 in the direction of the closed position, whereby the pole faces 8 and 9 increasingly overlap, while the angle α and the distance between the pole faces 8 and 9 become smaller. In the closed state, the pole faces 8 and 9 are parallel to each other at a defined distance, without being in contact. Due to the decreasing angle α, the increasing overlapping and the decreasing distance between the pole faces 8 and 9 during the closing process, the inductance of the arrangement from the coil 30 and the core unit 1 is strongly and evenly increased. The force component generated by the magnetic flux in the movement direction of the armature pole face 8 is reduced by the geometrical arrangement of the armature 6 and the core pole face 9 during the closing process. The result of both effects is an armature movement which is slow in comparison with a conventional folding armature system.

In this embodiment, the movement of the armature 6 is limited by a stop, which is formed from the armature bearing surface 11. The armature bearing surface 11 can either be level or display any other structure, for instance in order to optimise the stopping behavior. This stop in connection with the projections 14 ensures that, in the closed position, a residual working air gap 10 remains between the pole faces 8 and 9. In the region of the pole faces 8 and 9, no switching noise is thus created. On the armature bearing surface 11, an impact noise is created, however, the speed of the movement of the armature 6 on this surface is significantly lower than at the armature pole face 8, so that the impact of the armature 6 on the armature bearing surface 11 is quieter than the impact of an armature pole face on a core pole face of a conventional folding armature system.

In addition, due to the slow armature movement, the impact of the armature 6 on the armature bearing surface 11 as well as the impact of a contact pair which is to be connected to the armature 6, are particularly low in noise.

A magnet system according to the invention can display different configurations. The core unit and the armature can be optimised in such a manner that for instance a particularly compact structure is achieved or the pole faces can be designed to be particularly large to ensure a particularly good magnetic flux. The configuration of a contact system for combining with the armature can also influence the design of the armature and the core unit.

Figure 4:
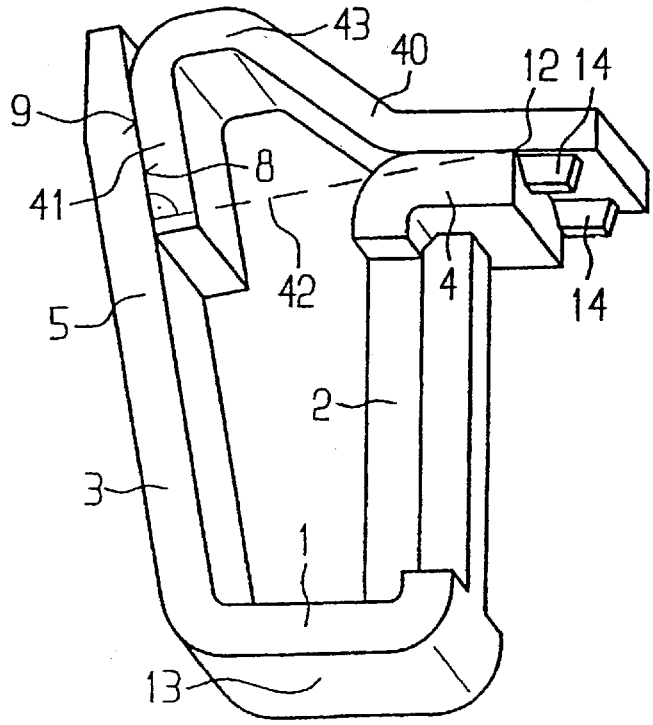
FIGS. 4–6 show alternative embodiments of magnet systems according to the invention.

In the embodiment shown in FIG. 4, an armature 40 is outwardly bent in a middle section 43 and thus deviates from the straight L-shape. The transverse leg of the L, which corresponds to a free armature end 41, points inwardly, in contrast to the examples shown in FIG. 1 to 3. Nevertheless, a connecting line 42 between the bearing edge 12 and the core pole face 9 is perpendicular to the armature pole face 8 as well as to the core pole face 9 in the closing position.

Figure 5:
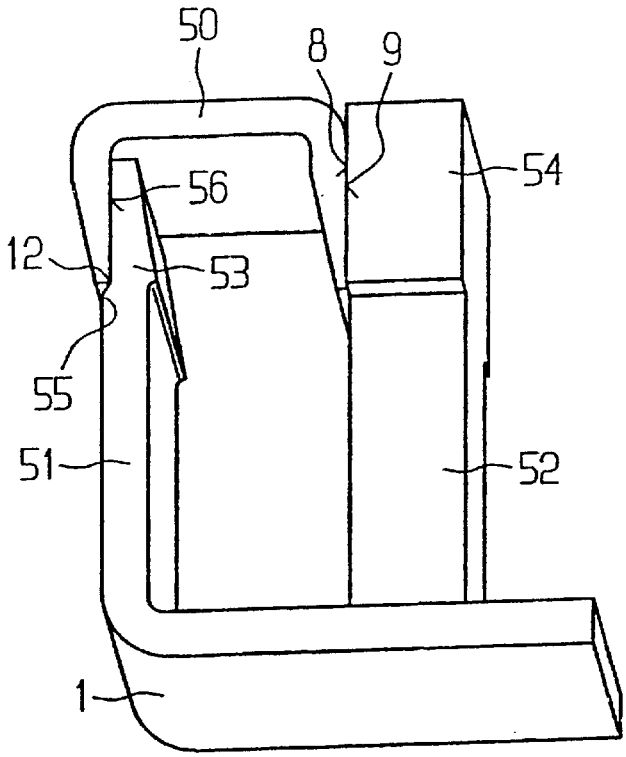
Figure 6:
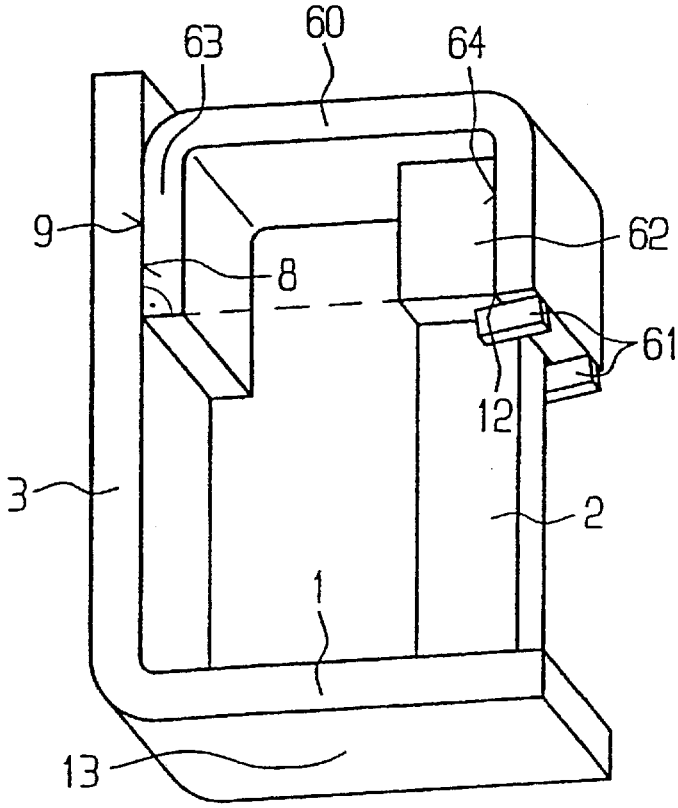

A further possibility of a configuration of a magnet system according to the invention is shown in the embodiment of FIG. 5. The coil is to be arranged on a second leg 52. A first leg 51 comprises on its outside a shoulder 55, which cooperates with a U-shaped armature 50 and forms the bearing edge 12. The armature 50 thus grips over the first leg 51. The stopping action takes place on an armature bearing surface 56 of an armature bearing section 53, which in this case is positioned parallel to the core pole face 9 on a pole section 54, in contrast to the armature bearing surface 11 in FIG. 1 to 4. In the embodiment of FIG. 6, an armature 60 is also designed to be U-shaped. The bearing edge 12 and a coil (not shown) are positioned on the same leg 2, in contrast to the example of FIG. 5. A further difference is the fixing of the position of the bearing edge 12, achieved by means of two projections 61. These projections 61 grip around an armature bearing section 62 in conjunction with the armature 60, so that the arrangement of the armature 60 and the projections 61 is adjacent to the armature bearing section 62 in the closed position on two sides and to an edge on a third side. As in the example of FIG. 5, an armature bearing surface 64 is positioned parallel to the armature pole face 8 on a pole section 63.

What is claimed is:

1. A magnet system for a relay comprising:

a core unit with at least two legs, whereby at least one armature bearing section is created on a first leg and a pole section is created on a second leg, an armature, which is pivotally mounted on the armature bearing section around a bearing edge and preloaded by a spring force in an open position, whereby a working air gap is created between an armature pole face on a free armature end and a core pole face on the pole section, the armature bearing section has a stop that limits movement of the armature when the armature moves to a closed-position, and a coil, which surrounds the core unit at any chosen position, wherein the armature pole face in the region of its front end in the closing direction is essentially perpendicular to a connecting line towards the bearing edge and in that the core pole face extends at least substantially parallel to the armature pole face when the armature is attracted.

2. The magnet system according to claim 1, wherein the armature pole face and the core pole face run in an essentially straight line in the moving direction of the armature and form an acute angle (α) when the armature is open.

3. The magnet system according to claim 1, wherein a residual working air gap remains between the pole faces in the closed position.

4. The magnet system according to claim 1, further comprising a second air gap between an armature bearing surface on the armature bearing section and the armature which, due to the position of the armature on this end section, is wedge-shaped during the opened armature position, and during the closed armature position disappears to a large extent.

5. The magnet system according to claim 4, wherein the armature bearing surface is curved.

6. The magnet system according to claim 1, wherein the armature during closing only partly touches down on the stop.

7. The magnet system according to claim 1, wherein the longitudinal axes of the armature bearing section and of the pole section are positioned on the movement plane of the armature.

8. The magnet system according to claim 1, wherein the longitudinal axes of the armature bearing section and of the pole section are not parallel to each other.

9. The magnet system according to claim 1, wherein the armature includes projections that abut the stop.

10. The magnet system according to claim 1, wherein the first leg and the second leg are connected by a cross piece such that the core unit is U-shaped.

11. The magnet system according to claim 10, wherein the free armature end points inward toward the cross piece.

12. A magnet system for a relay comprising:

a core unit with at least two legs, whereby at least one armature bearing section is created on a first leg and a pole section is created on a second leg, an armature, which is pivotally mounted on the armature bearing section around a bearing edge and preloaded by a spring force in an open position, whereby a working air gap is created between an armature pole face on a free armature end and a core pole face on the pole section, the armature is essentially U-shaped, and a coil, which surrounds the core unit at any chosen position, wherein the armature pole face in the region of its front end in the closing direction is essentially perpendicular to a connecting line towards the bearing edge and in that the core pole face extends at least substantially parallel to the armature pole face when the armature is attracted.

13. The magnet system according to claim 12, wherein the core pole face is positioned parallel to an armature bearing surface of the armature bearing section.

14. The magnet system according to claim 12, wherein the armature bearing surface limits the movement of the armature.

15. A magnet system for a relay comprising:

a core unit with at least two legs, whereby at least one armature bearing section is created on a first leg and a pole section is created on a second leg, an armature, which is pivotally mounted on the armature bearing section around a bearing edge and preloaded by a spring force in an open position, whereby a working air gap is created between an armature pole face on a free armature end and a core pole face on the pole section, the armature is S-shaped in such a manner, that in each end region an essentially even surface is created, whereby one is positioned opposite the core pole face and the other opposite the armature bearing surface, and a coil, which surrounds the core unit at any chosen position, wherein the armature pole face in the region of its front end in the closing direction is essentially perpendicular to a connecting line towards the bearing edge and in that the core pole face extends at least substantially parallel to the armature pole face when the armature is attracted.

16. The magnet system according to claim 15, wherein the armature pole face and the core pole face form an acute angle when the armature is in the open position such that a wedge-shaped working air gap is formed therebetween.

17. The magnet system according to claim 16, wherein an aperture angle corresponding to the acute angle is formed between the armature and an armature bearing surface on the armature bearing section, the aperture angle is between 6 degrees and 15 degrees.

18. The magnet system according to claim 15, wherein the armature pole face and the core pole face do not completely overlap in the closed position.

19. The magnet system according to claim 15, wherein the armature has projections that abut a stop on the armature bearing section to limit movement of the armature.

20. A magnet system for a relay comprising:

a core unit with at least two legs, whereby at least one armature bearing section is created on a first leg and a pole section is created on a second leg, an armature, which is pivotally mounted on the armature bearing section around a bearing edge and preloaded by a spring force in an open position, whereby a working air gap is created between an armature pole face on a free armature end and a core pole face on the pole section, the armature is essentially L-shaped, whereby a middle section is bent with relation to the section of the armature located on the armature bearing section and end regions of the armature form essentially straight sections, whereby one of the straight sections of the armature is positioned in a plane, which cuts the other straight section in approximately the middle of its longitudinal extension, and a coil, which surrounds the core unit at any chosen position, wherein the armature pole face in the region of its front end in the closing direction is essentially perpendicular to a connecting line towards the bearing edge and in that the core pole extends at least substantially parallel to the armature pole face when the armature is attracted.

21. The magnet system according to claim 20, wherein the first leg and the second leg are connected by a cross-piece such that the core unit is U-shaped.

22. The magnet system according to claim 21, wherein the first and second leg are not parallel to each other.

23. The magnet system according to claim 21, wherein the free armature end points inward toward the cross piece.

24. The magnet system according to claim 20, wherein the armature has projections that abut a stop on the armature bearing section to limit movement of the armature.

* * * * *